US011628341B2

(12) United States Patent
Buergin

(10) Patent No.: US 11,628,341 B2
(45) Date of Patent: Apr. 18, 2023

(54) GOLF-TEE MOUNT

(71) Applicant: James F. Buergin, Indianapolis, IN (US)

(72) Inventor: James F. Buergin, Indianapolis, IN (US)

( * ) Notice: Subject to any disclaimer, the term of this patent is extended or adjusted under 35 U.S.C. 154(b) by 0 days.

(21) Appl. No.: 17/675,220

(22) Filed: Feb. 18, 2022

(65) Prior Publication Data

US 2022/0168618 A1 Jun. 2, 2022

Related U.S. Application Data

(63) Continuation-in-part of application No. 29/753,989, filed on Oct. 5, 2020, now Pat. No. Des. 955,516.

(60) Provisional application No. 63/241,462, filed on Sep. 7, 2021.

(51) Int. Cl.
*A63B 57/13* (2015.01)

(52) U.S. Cl.
CPC ..... *A63B 57/13* (2015.10)

(58) Field of Classification Search
CPC ..... A63B 57/13; A63B 57/10; A63B 57/15
See application file for complete search history.

(56) References Cited

U.S. PATENT DOCUMENTS 1,588,038 A * 6/1926 Miller ..... A63B 57/10 473/401
3,645,537 A * 2/1972 Parenteau ..... A63B 57/10 473/401
4,893,818 A * 1/1990 Liccardello ..... A63B 57/353 473/402
4,976,431 A 12/1990 Guenther
4,998,732 A * 3/1991 Gallant ..... A63B 57/10 473/401
5,242,170 A * 9/1993 Ward ..... A63B 57/10 473/401
7,052,416 B2 5/2006 Chang
8,029,387 B2 * 10/2011 Breton ..... A63B 57/10 473/387
D759,770 S * 6/2016 Regan ..... D21/718
9,358,440 B1 6/2016 Burrell
9,937,398 B1 * 4/2018 Iverson ..... B29C 45/1418
(Continued)

FOREIGN PATENT DOCUMENTS

WO WO-03015877 A1 * 2/2003 ..... A63B 57/10
WO WO2007105379 A1 9/2007

*Primary Examiner* — Steven B Wong

(57) ABSTRACT

A golf-tee mount is an apparatus that easily and effectively secures a golf-tee body into the ground. The apparatus includes golf-tee body, a mountable base, and a plurality of spikes. The golf-tee body upholds a golf ball that is about to be hit and is preferably made of a flexible material. The mountable base stabilizes and attaches the golf-tee body into the ground and allows the golf-tee body to be interchangeable as needed and is preferably made of a rigid material. Furthermore, the mountable base may remain connected with the ground while interchanging the golf-tee body. The plurality of spikes penetrates the ground and allows a user to easily fasten the mountable base, and consequently the golf-tee body, into the ground. The golf-tee body further includes a plurality of finger-receiving grooves that allows the user to better grip the golf-tee body while connecting the golf-tee body with the mountable base.

18 Claims, 5 Drawing Sheets

(56) References Cited

U.S. PATENT DOCUMENTS

| | | | | |
|---|---|---|---|---|
| D955,516 | S * | 6/2022 | Buergin | A63B 57/13<br>D21/717 |
| 2001/0029212 | A1* | 10/2001 | Dovigi | A63B 57/10<br>473/387 |
| 2003/0148830 | A1* | 8/2003 | Hsiao | A63B 57/10<br>473/387 |
| 2006/0264272 | A1* | 11/2006 | Calderon | A63B 57/10<br>473/387 |
| 2017/0106258 | A1* | 4/2017 | Rost | A63B 57/10 |
| 2021/0031079 | A1 | 2/2021 | Cooper | |

* cited by examiner

GOLF-TEE MOUNT

The current application claims a priority to the U.S. Provisional Patent application Ser. No. 63/241,462 filed on Sep. 7, 2021.

The current application is also a continuation-in-part (CIP) application of the U.S. design application Ser. No. 29/753,989 filed on Oct. 5, 2020.

FIELD OF THE INVENTION

The present invention generally relates to sports equipment and golf accessories. More specifically, the present invention provides is a golf-tee mount.

BACKGROUND OF THE INVENTION

The present invention provides a new golf tee design. The golf tee of the present invention, preferably referred to as the Shur-T, is an innovative, virtually indestructible golf tee that is easier to use by players of all ages and skills. Traditional golf tees require to be stuck into the ground approximately half an inch to one inch deep, which can be difficult on frozen or hard grounds. On the other hand, the present invention only needs to be stuck a quarter of an inch into the ground. The present invention is especially useful when the ground is hard to penetrate or for older players who have problems inserting normal golf tees.

The present invention includes a tee body preferably made from molded rubber. The present invention also has a triangle-shaped base with side lengths of one inch each. The base of the present invention further has multiple spikes, preferably one quarter inch plastic spikes on the bottom. The base of the present invention is made from molded plastic. The base is inserted into the bottom of the tee body. In addition, the tee body will include a matching triangle-shaped base tapering to an approximate quarter inch diameter shaft. The height of the tee body can vary from half an inch to one inch, to one and half inch, and up to two-inch heights.

DETAILED DESCRIPTIONS OF THE INVENTION

Figure 1:
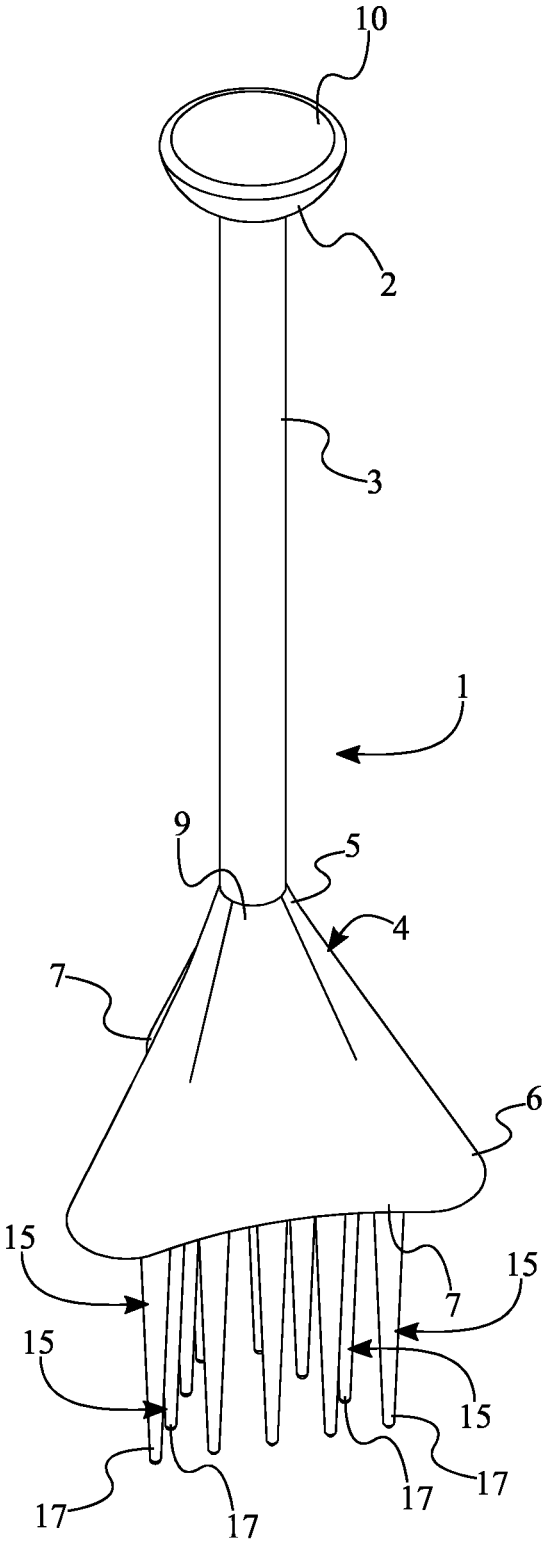
FIG. 1 is a perspective view of the present invention.

All illustrations of the drawings are for the purpose of describing selected versions of the present invention and are not intended to limit the scope of the present invention.

The present invention is a golf-tee mount. The present invention securely and easily upholds a golf ball with the ground. More specifically, the present invention positions a golf ball that is about to be swung at by a golfer. The present invention requires minimal effort to insert into the ground. Moreover, the present invention allows a user to interchange or replace a golf-tee while maintaining a desired position across the ground. The present invention comprises a golf-tee body 1, a mountable base 11, and a plurality of spikes 15, seen in FIG. 2 and FIG. 3. The golf-tee body 1 upholds the and supports the weight of a golf ball and allows a golf ball to be readily hit by the head of a golf club. The golf-tee body 1 comprises a tee head 2, a tee stem 3, and a tee receptacle 4. The tee head 2 cradles a golf ball. The tee stem 3 offsets the tee head 2 from the tee receptacle 4, and consequently the ground. The tee receptacle 4 connects the golf-tee body 1 with the mountable base 11. The mountable base 11 stabilizes the tee receptacle 4 across the ground. The mountable base 11 comprises a proximal base face 12 and a distal base face 13. The proximal base face 12 presses against the tee receptacle 4, and the distal base face 13 presses against the ground. The plurality of spikes 15 mounts the mountable base 11 into the ground, and consequently the golf-tee body 1 while engaged with the mountable base 11. Moreover, the plurality of spikes 15 pierces the ground to facilitate the connection between the mountable base 11 and the ground. In the preferred embodiment of the present invention, the golf-tee body 1 is made of a flexible material. Furthermore, the mountable base 11 and the plurality of spikes 15 are made of rigid material. The flexible material is preferably rubber, and the rigid material is preferably a hard plastic.

Figure 2:
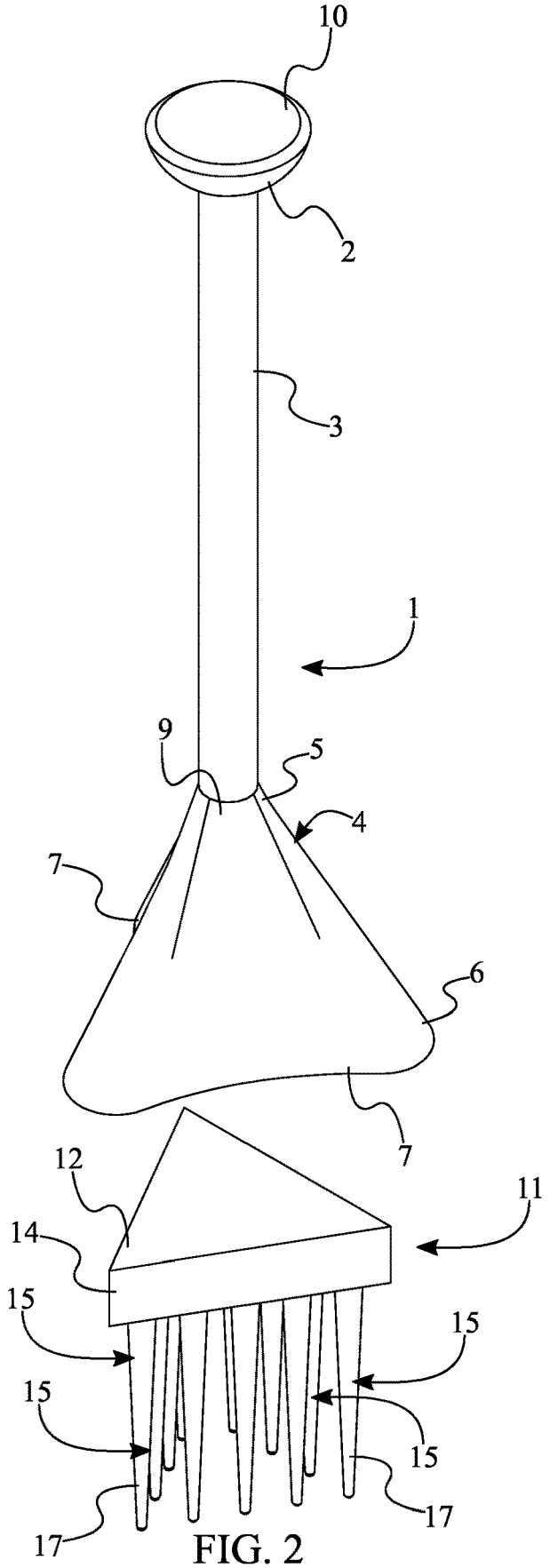
FIG. 2 is a front top exploded view of the present invention.
Figure 3:
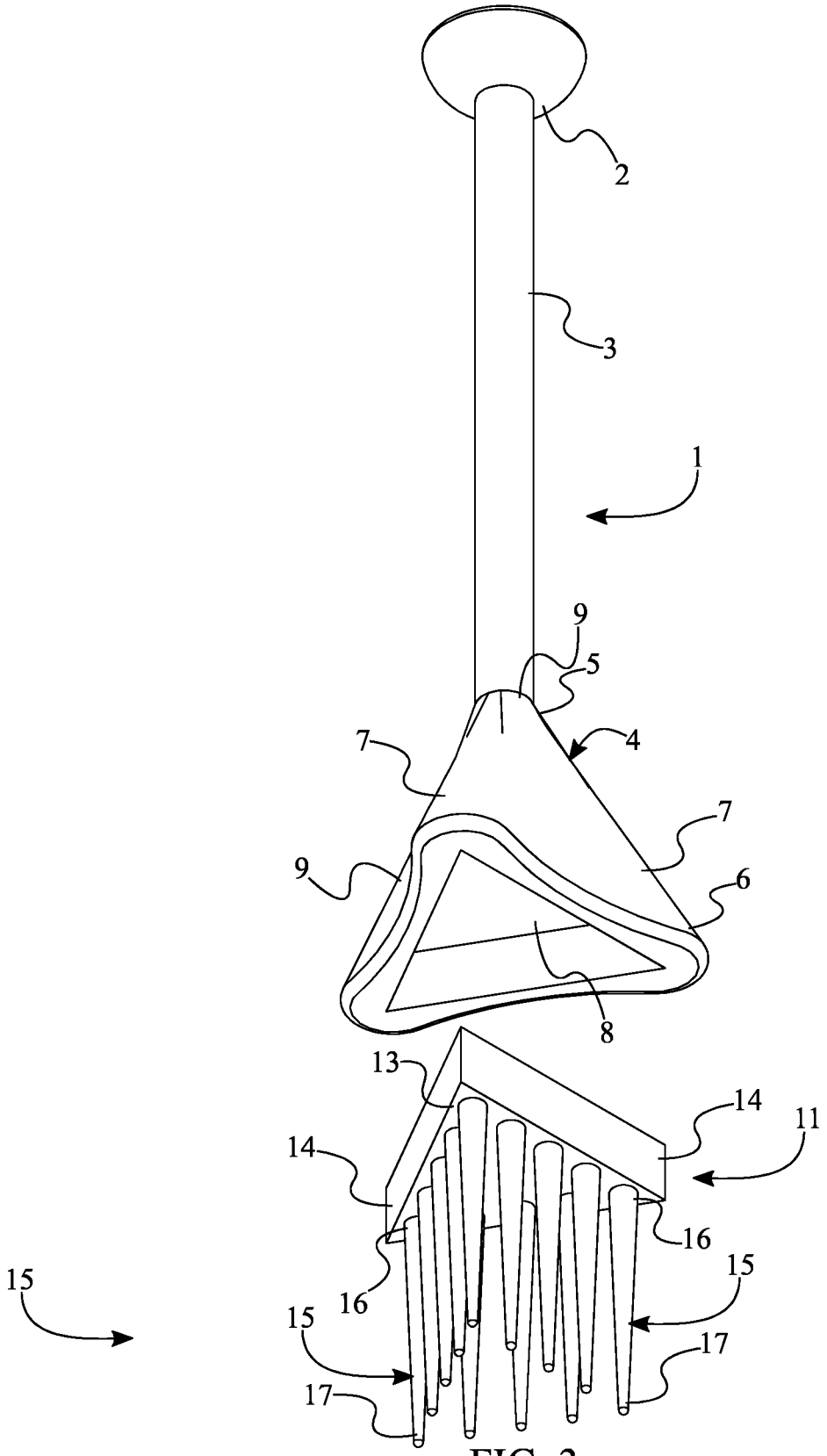
FIG. 3 is a rear bottom exploded view of the present invention.
Figure 4:
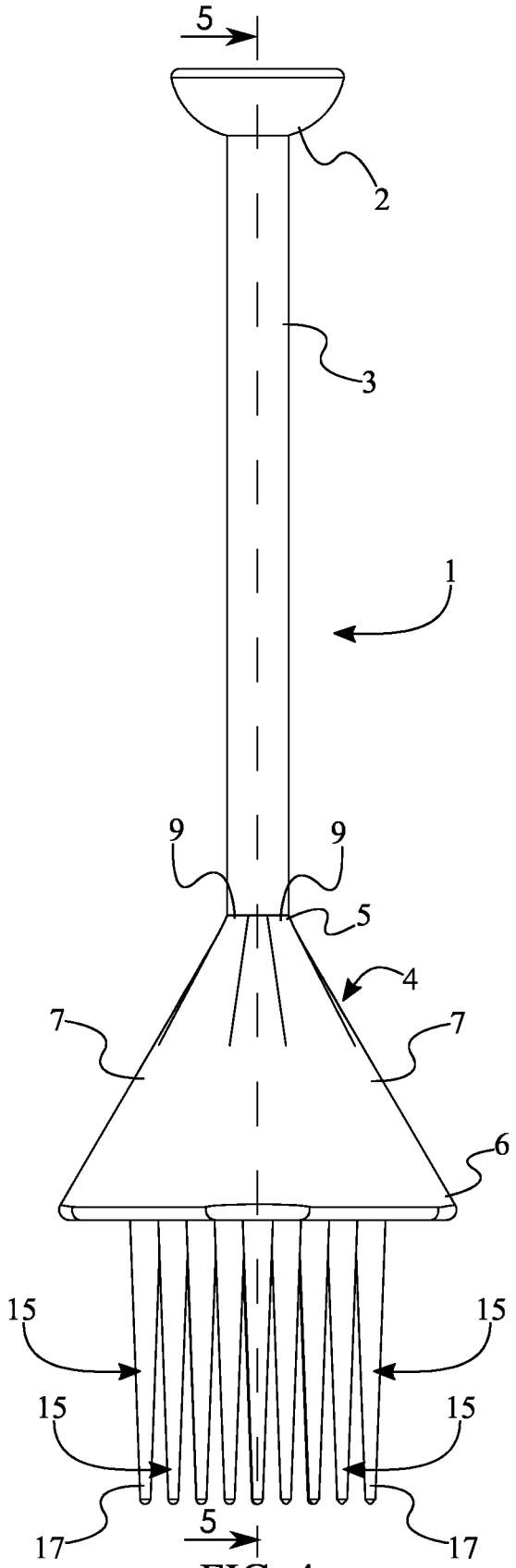
FIG. 4 is a front side view of the present invention.

The overall arrangement of the aforementioned components allows the golf-tee body 1 to be interchangeable with a mountable base 11 without having to remove the present invention from the ground. In order for a golf ball to remain balanced while remaining uplifted from the ground, the tee head 2 is terminally fixed with the tee stem 3, seen in FIG. 1, FIG. 2, FIG. 3, FIG. 4, and FIG. 5. The tee receptacle 4 is terminally fixed with the tee stem 3 opposite the tee head 2, offsetting a golf ball with the ground. A height of the mountable base 11 provides a stable platform for the golf-tee body 1 as the proximal base face 12 is positioned opposite the distal base face 13 about the mountable base 11. Moreover, the distal base face 13 is oriented away from the golf-tee body 1, thereby pressing against the ground. In order for the plurality of spikes 15 to freely penetrate the ground and continuously traverse into the ground, each of the plurality of spikes 15 is connected normal with the distal base face 13. Moreover, the plurality of spikes 15 is distributed across the distal base face 13 such that the position of the mountable base 11 across the ground is secure and the mountable base 11 does not readily move from side to side. In the preferred embodiment of the present invention, the plurality of spikes 15 is perimetrically distributed around the distal base face 13. As the mountable base 11 is frictionally engaged into the tee receptacle 4, the proximal base face 12 is positioned within the tee receptacle 4. As seen in FIG. 1, FIG. 2, and FIG. 3, the mountable base 11 is removably attached into the tee receptacle 4, thereby securing a desired position for the golf-tee body 1 as defined by the mountable base 11.

In order to reinforce the structural integrity of the present invention as the golf-tee body 1 is separable from the mountable base 11, the tee receptacle 4 comprises a closed end 5 and an open end 6, seen in FIG. 2 and FIG. 3. The closed end 5 connects the tee stem 3 with the tee receptacle 4. The open end 6 provides a path for the mountable base 11 into the tee receptacle 4. In order for the mountable base 11 to be positioned within the tee receptacle 4, more specifically be flushed within the tee receptacle 4, the closed end 5 is positioned opposite the open end 6 about the tee receptacle 4. The tee stem 3 is positioned coincident with the closed end 5, thereby upholding a golf ball upright from the ground. As the mountable base 11 is positioned within the tee receptacle 4, the proximal base face 12 is positioned in between the closed end 5 and the open end 6. The distal base face 13 is positioned coincident with the open end 6, maintaining an uninhibited engagement between the plurality of spikes 15 with the ground. The upright orientation of the tee stem 3 is structurally reinforced as the tee receptacle 4 tapers from the open end 6 to the closed end 5.

In order to easily fasten the golf-tee body 1 onto the mountable base 11, the golf-tee body 1 may further comprise a plurality of finger-receiving grooves 9, seen in FIG. 1, FIG. 2, FIG. 3, and FIG. 4. Moreover, the tee receptacle 4 may further comprise a plurality of lateral receptacle walls 7. The plurality of lateral receptacle walls 7 connects the golf-tee body 1 with the mountable base 11. The golf-tee body 1 is positioned on the ground as the plurality of lateral receptacle walls 7 is positioned around the mountable base 11. The plurality of finger-receiving grooves 9 is externally positioned to the tee receptacle 4 such that the plurality of finger-receiving grooves 9 is accessible to the grip of a user. Each of the plurality of finger-receiving grooves 9 is integrated into a corresponding wall from the plurality of lateral receptacle walls 7 in order to provide an ergonomic structure for the golf-tee body 1.

In order for the mountable base 11 to frictionally engage with the tee receptacle 4 and be frictionally engaged with the tee receptacle 4, the mountable base 11 may further comprise a plurality of lateral base faces 14, seen in FIG. 1, FIG. 2, FIG. 3, and FIG. 4. The plurality of lateral base faces 14 presses against the tee receptacle 4. The plurality of lateral base faces 14 is positioned in between the proximal base face 12 and the distal base face 13, thereby defining an overall shape for the mountable base 11. Each of the plurality of lateral receptacle walls 7 is positioned against and across a corresponding face from the plurality of lateral base faces 14, thereby providing a flushed arrangement between the mountable base 11 and the tee receptacle 4. In the preferred embodiment of the present invention, the plurality of lateral base faces 14 is three base faces, and the three lateral base faces are arranged into a triangular configuration. Moreover, a ratio between a width of each of the three lateral base faces and a length of each of the plurality of spikes 15 is 1:4. Likewise, the plurality of lateral receptacle walls 7 is three lateral receptacle walls, and the three lateral receptacle walls are arranged into a triangular configuration. It is understood that various embodiments of the present invention may comprise varying amounts of bases faces of the plurality of lateral base faces 14 and varying amounts of lateral receptacle walls of the plurality of lateral receptacle walls 7 that are arranged in various shapes.

In order for the proximal base face 12 to firmly and evenly press into the tee receptacle 4, the tee receptacle 4 may comprise a closed end 5, an open end 6, and a flat surface 8, seen in FIG. 3. The closed end 5 connects the tee stem 3 with the tee receptacle 4. The open end 6 provides a path for the mountable base 11 into the tee receptacle 4. In order for the mountable base 11 to be positioned within the tee receptacle 4, more specifically be flushed within the tee receptacle 4, the closed end 5 is positioned opposite the open end 6 about the tee receptacle 4. The flat surface 8 is positioned within the tee receptacle 4 and is integrated into the closed end 5 such that the flat surface 8 readily receives the proximal base face 12 while the mountable base 11 is fully engaged into the tee receptacle 4. The mountable base 11 is immovable within the tee receptacle 4 as the proximal base face 12 is positioned against and across the flat surface 8, as seen in FIG. 5.

In order for the plurality of spikes 15 to easily penetrate into the ground while maintaining the connection with the movable base, each of the plurality of spikes 15 may comprise a blunt end 16 and a pointed end 17, seen in FIG. 3. The blunt end 16 comprises a thicker width that preserves the structural integrity of each spike of the plurality of spikes 15. The pointed end 17 pierces into the ground. The blunt end 16 is positioned coincident with the distal base face 13, thereby connecting each spike of the plurality of spikes 15 with the mountable base 11. The pointed end 17 is positioned offset from the distal base face 13 in order to come into contact with the ground first and channeling a path for the remainder of the corresponding spike of the plurality of spikes 15 to traverse into the ground.

Figure 5:
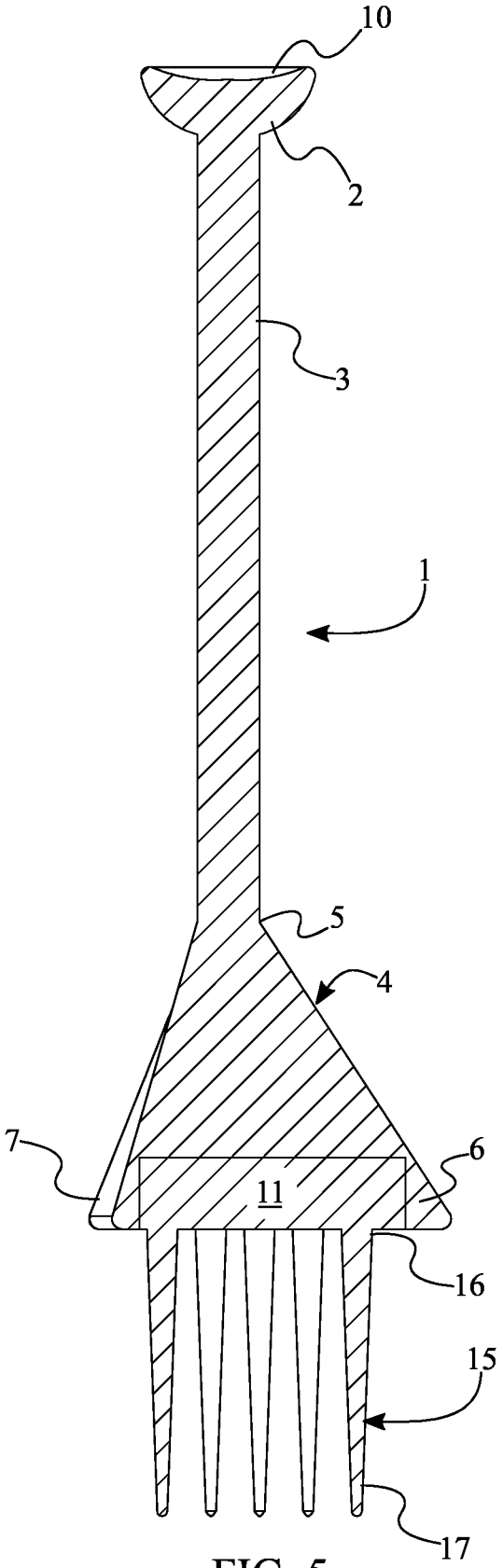
FIG. 5 is a cross-section view taken along line 5-5 in FIG. 4.

In order to uphold a golf ball, the golf-tee body 1 may further comprise a golf-ball-situating dimple 10, seen in FIG. 1, FIG. 2, and FIG. 5. The golf-ball-situating dimple 10 receives a golf ball and allows a golf ball to rest into the tee head 2. The tee head 2 cradles a golf ball as the golf-ball-situating dimple 10 is integrated into the tee head 2, opposite the tee stem 3.

Although the invention has been explained in relation to its preferred embodiment, it is to be understood that many other possible modifications and variations can be made without departing from the spirit and scope of the invention as hereinafter claimed.

What is claimed is:

1. A golf-tee mount comprising:

a golf-tee body;

a mountable base;

a plurality of spikes;

the golf-tee body comprising a tee head, a tee stem, a tee receptacle, a plurality of finger-receiving grooves;

the mountable base comprising a proximal base face and a distal base face;

the tee receptacle comprising a plurality of lateral receptacle walls;

the tee head being terminally fixed with the tee stem;

the tee receptacle being terminally fixed with the tee stem, opposite the tee head;

the proximal base face being positioned opposite the distal base face about the mountable base;

the distal base face being oriented away from the golf-tee body;

each of the plurality of spikes being connected normal with the distal base face;

the plurality of spikes being distributed across the distal base face;

the proximal base face being positioned within the tee receptacle;

the mountable base being removably attached into the tee receptacle;

the plurality of lateral receptacle walls being positioned around the mountable base;

the plurality of finger-receiving grooves being externally positioned to the tee receptacle; and each of the plurality of finger-receiving grooves being integrated into a corresponding wall from the plurality of lateral receptacle walls.

2. The golf-tee mount as claimed in claim 1 comprising:

the tee receptacle further comprising a closed end and an open end;

the closed end being positioned opposite the open end about the tee receptacle;

the tee stem being positioned coincident with the closed end;

the proximal base face being positioned in between the closed end and the open end;

the distal base face being positioned coincident with the open end; and the tee receptacle tapering from the open end to the closed end.

3. The golf-tee mount as claimed in claim 1 comprising:

the mountable base further comprising a plurality of lateral base faces;

the plurality of lateral base faces being positioned in between the proximal base face and the distal base face; and each of the plurality of lateral receptacle walls being positioned against and across a corresponding face from the plurality of lateral base faces.

4. The golf-tee mount as claimed in claim 3, wherein the plurality of lateral base faces is three base faces, and wherein the three lateral base faces are arranged into a triangular configuration, and wherein a ratio between a width of each of the three lateral base faces and a length of each of the plurality of spikes is 1:4.

5. The golf-tee mount as claimed in claim 1, wherein the plurality of lateral receptacle walls is three lateral receptacle walls, and wherein the three lateral receptacle walls are arranged into a triangular configuration.

6. The golf-tee mount as claimed in claim 1 comprising:

the tee receptacle further comprising a closed end, an open end, and a flat surface;

the closed end being positioned opposite the open end about the tee receptacle;

the flat surface being positioned within the tee receptacle;

the flat surface being integrated into the closed end; and the proximal base face being positioned against and across the flat surface.

7. The golf-tee mount as claimed in claim 1 comprising:

each of the plurality of spikes comprising a blunt end and a pointed end;

the blunt end being positioned coincident with the distal base face; and the pointed end being positioned offset from the distal base face.

8. The golf-tee mount as claimed in claim 1 comprising:

the golf-tee body further comprising a golf-ball-situating dimple; and the golf-ball-situating dimple being integrated into the tee head, opposite the tee stem.

9. The golf-tee mount as claimed in claim 1, wherein the golf-tee body is made of a flexible material, and wherein the mountable base and the plurality of spikes are made of a rigid material.

10. The golf-tee mount as claimed in claim 9, wherein the flexible material is rubber, and wherein the rigid material is a hard plastic.

11. A golf-tee mount comprising:

a golf-tee body;

a mountable base;

a plurality of spikes;

the golf-tee body comprising a tee head, a tee stem, a tee receptacle, a plurality of finger-receiving grooves, and a golf-ball-situating dimple;

the tee receptacle comprising a plurality of lateral receptacle walls;

the mountable base comprising a proximal base face and a distal base face;

the tee head being terminally fixed with the tee stem;

the tee receptacle being terminally fixed with the tee stem, opposite the tee head;

the proximal base face being positioned opposite the distal base face about the mountable base;

the distal base face being oriented away from the golf-tee body;

each of the plurality of spikes being connected normal with the distal base face;

the plurality of spikes being distributed across the distal base face;

the proximal base face being positioned within the tee receptacle;

the mountable base being removably attached into the tee receptacle;

each of the plurality of spikes comprising a blunt end and a pointed end;

the plurality of lateral receptacle walls being positioned around the mountable base;

the plurality of finger-receiving grooves being externally positioned to the tee receptacle;

each of the plurality of finger-receiving grooves being integrated into a corresponding wall from the plurality of lateral receptacle walls;

the golf-ball-situating dimple being integrated into the tee head, opposite the tee stem;

the blunt end being positioned coincident with the distal base face; and the pointed end being positioned offset from the distal base face.

12. The golf-tee mount as claimed in claim 11 comprising:

the tee receptacle further comprising a closed end and an open end;

the closed end being positioned opposite the open end about the tee receptacle;

the tee stem being positioned coincident with the closed end;

the proximal base face being positioned in between the closed end and the open end;

the distal base face being positioned coincident with the open end; and the tee receptacle tapering from the open end to the closed end.

13. The golf-tee mount as claimed in claim 11 comprising:

the mountable base further comprising a plurality of lateral base faces;

the plurality of lateral base faces being positioned in between the proximal base face and the distal base face; and each of the plurality of lateral receptacle walls being positioned against and across a corresponding face from the plurality of lateral base faces.

14. The golf-tee mount as claimed in claim 13, wherein the plurality of lateral base faces is three base faces, and wherein the three lateral base faces are arranged into a triangular configuration, and wherein a ratio between a width of each of the three lateral base faces and a length of each of the plurality of spikes is 1:4.

15. The golf-tee mount as claimed in claim 11, wherein the plurality of lateral receptacle walls is three lateral receptacle walls, and wherein the three lateral receptacle walls are arranged into a triangular configuration.

16. The golf-tee mount as claimed in claim 11 comprising:

the tee receptacle further comprising a closed end, an open end, and a flat surface;

the closed end being positioned opposite the open end about the tee receptacle;

the flat surface being positioned within the tee receptacle;

the flat surface being integrated into the closed end; and the proximal base face being positioned against and across the flat surface.

17. The golf-tee mount as claimed in claim 11, wherein the golf-tee body is made of a flexible material, and wherein the mountable base and the plurality of spikes are made of a rigid material.

18. The golf-tee mount as claimed in claim 17, wherein the flexible material is rubber, and wherein the rigid material is a hard plastic.

* * * * *